United States Patent [19]

Shreeve

[11] Patent Number: 4,926,008

[45] Date of Patent: May 15, 1990

[54] HIGH CAPACITANCE CABLE

[75] Inventor: Robert W. Shreeve, Corvallis, Oreg.

[73] Assignee: Hewlett-Packard Company, Palo Alto, Calif.

[21] Appl. No.: 353,949

[22] Filed: May 18, 1989

[51] Int. Cl.[5] ..... H01B 7/08

[52] U.S. Cl. ..... 174/117 FF; 174/72 B

[58] Field of Search ..... 174/68.2, 70 R, 70 B, 174/72 B, 117 FF, 117 PC; 333/116, 128, 161, 204, 238, 246, 247; 361/407, 408

[56] References Cited

U.S. PATENT DOCUMENTS 2,774,046 12/1956 Arditi et al. ..... 333/238 X 4,130,723 12/1978 Wakeling ..... 174/117 PC X 4,490,690 12/1984 Suzuki ..... 333/238 X

*Primary Examiner*—Laramie E. Askin

*Attorney, Agent, or Firm*—S. A. Kassatly

[57] ABSTRACT

A high capacitance cable is described which avoids instantaneous voltage drops. The cable is very useful in connecting electrical components (e.g., connecting integrated circuit chips to power supplies). The cable includes: (a) a central continuous strip which is electrically insulating, (b) spaced-apart conductors carried on the upper surface of the strip, and (c) spaced-apart conductors carried on the lower surface of the strip. The cable can be surrounded by electrical insulation, and it preferably is a flexible cable.

16 Claims, 2 Drawing Sheets

HIGH CAPACITANCE CABLE

FIELD OF THE INVENTION

This invention relates to procedures and techniques for connecting electrical devices. Even more particularly, this invention relates to a high capacitance cable which is useful in connecting integrated circuit chips to power supplies. In another aspect this invention relates to burn-in systems for integrated circuit chips.

BACKGROUND OF THE INVENTION

When integrated circuit chips are cycled (e.g., during burn-in) they require instantaneous currents at their power pins. These high speed current transients induce instantaneous voltage drops in the power distribution lines leading to the integrated circuit chip. If these voltage drops exceed a couple of volts, the chip performs unpredictably. As a result, it is desirable to be able to hold these instantaneous voltage drops to a minimum.

Previously, the cables used for supplying power to integrated circuit chips have been a major contributor to voltage drops due to the inherent inductance of such cables.

Another situation in which the inductance of conventional cables is detrimental is in burn-in of integrated circuit chips. Burn-in is often performed on integrated circuit chips after manufacture and before they are shipped from the foundry. Burn-in is used to reduce infant mortality failures which can result from manufacturing process anomalies.

On conventional surface mount parts the burn-in process includes the following steps: (1) electrical testing to verify that the part is good prior to burn-in; (2) loading the parts onto burn-in boards; (3) loading the burn-in boards into the burn-in oven one at a time; (4) verifying the burn-in signals on the burn-in boards; (5) dynamically cycling the parts for an extended period in the burn-in oven; (6) verifying the burn-in signals on the burn-in boards before the parts are removed from the oven to ensure that the board received the test vectors during the entire burn-in period; (7) unloading the parts from the burn-in boards; and (8) electrical testing of burned-in parts.

Current burn-in methods require the purchase, design and debug of burn-in and timing boards. More recent burn-in systems require the programming of PROMs to create the burn-in test vectors. The burn-in boards are typically socketed for individual parts. The sockets require the part to have fairly large leads to handle the large temperature excursion experienced during the burn-in oven on/off cycles. The cost of these sockets increases as the lead pitch becomes smaller.

The part packing density in the burn-in oven is fairly low, typically requiring eight cubic inches per part. This results in larger oven capacity requirements and 24 hour maximum burn-in times.

There has not heretofore been provided a high capacitance cable having the advantages provided by the present invention.

SUMMARY OF THE INVENTION

In accordance with the present invention there is provided a high capacitance cable which is not inductive. Consequently, significant voltage drops in the cable are avoided.

In one embodiment the high capacitance cable comprises:

(a) a central continuous strip which is electrically insulating; the strip having upper and lower surfaces along its length;

(b) spaced-apart first and second conductors carried on the upper surface of the strip; the conductors extending along the length of the strip; and (c) spaced-apart third and fourth conductors carried on the lower surface of the strip; the conductors extending along the length of the strip.

The electrical potentials of the first and third conductors are different from each other; and the electrical potentials of the second and fourth conductors are different from each other.

The cable may be surrounded or covered with electrical insulation. Preferably the cable is flexible.

The cable of the present invention is very useful, for example, for burn-in of integrated circuit chips so as to avoid the disadvantages associated with the conventional burn-in methods described above.

Using the cable of the present invention, integrated circuit chips can be subjected to burn-in after being bonded to TAB tape which comprises a continuous strip of flexible insulating substrate (e.g., polyimide) with repetitive lead frame patterns bonded to it along its length. An integrated circuit chip is bonded to each lead frame on the strip in an automated process geared for high volume production. The resulting strip or tape is rolled onto a reel for handling and storage.

Using the novel cable of this invention, burn-in testing of the TAB tape in reel form is possible. For example, there may be 200 integrated circuit chips or more on such a tape in one reel. This avoids the need to handle the parts individually. It also avoids the need to purchase or design carriers for individual parts, and it avoids the need to have an expensive burn-in socket which would meet the high pitch requirements for such parts.

Such burn-in system provides for inexpensive and rapid burn-in of large numbers of parts. Burn-in boards are eliminated, and oven part packing densities are increased.

Other advantages of the cable of this invention will be apparent from the following detailed description and the accompanying drawings. For example, the cable may be used as a power cable in computer systems, or in consumer products (e.g. video recorders, televisions, etc.), or RF transmitters for UHF.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
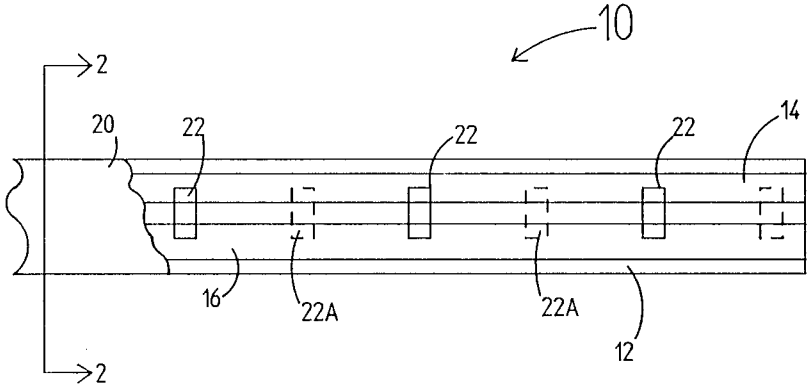
FIG. 1 is a partially cut-away top view of a high capacitance cable of the invention.

In FIG. 1 there is shown a top view of a high inductance cable 10 of the invention. The cable is an elongated strip comprising a central continuous portion or strip 12 which extends through the entire length of the cable. It is an electrically insulating material (e.g., polyimide or other such insulating material). Portion or strip 12 may vary in thickness and width (for example, it is preferably about 0.001 inch thick and about one inch wide, although other dimensions are also suitable). Portion or strip 12 is preferably flexible so that the cable may be easily bent around corners when used. It is also preferable for strip 12 to have a uniform thickness along its length.

To the upper surface of strip 12 there are secured two spaced-apart conductive strips 14 and 16. Preferably each of these strips is composed of metal (e.g. copper, aluminum, gold, etc. or conductive non-metals such as acetylnitrile). The thickness of the strips may vary. Typically the thickness of each strip is about 0.001 inch, and preferably the width of each strip is about 0.5 inch. In all cases the width of each strip is many times greater than its thickness. In other words, each conductor is essentially planar.

Strip 14 is intended to serve as a ground conductor. Strip 16 is intended to serve as Vdd (e.g. +5 volts).

Connected between strip 14 and strip 16 at periodic intervals are capacitors 22. The capacitors 22 are preferably monolithic chip capacitors. These are low inductance capacitors. Typically they are about 0.020 inch in height, about 0.2 inch in width, and about 0.05 to 0.1 inch in length. The spacing between each such capacitor 22 along the top of the cable is preferably about one inch. The closer the spacing between the capacitors, the more preferred the characteristics of the cable. However, the cable is also capacitive and useful even if there are no capacitors mounted thereon.

Figure 2:
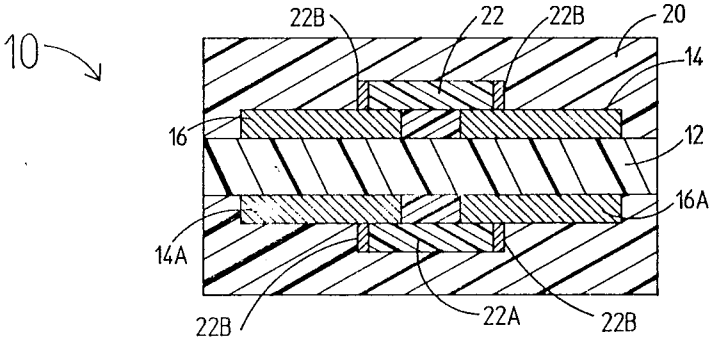
FIG. 2 is a cross-sectional view of the cable shown in FIG. 1 taken along line 2—2.

As illustrated in the cross-sectional view of FIG. 2, opposite ends 22B of each capacitor are composed of metal which enables one end of each capacitor to be soldered or bonded to the upper surface of strip 14 and the opposite end to be soldered or bonded to the upper surface of strip 16.

On the underside of strip 12 there are secured spaced-apart conductive strips 14A and 16A as illustrated in FIG. 2. Conductive strip 14A is the ground conductor and conductive strip 16A is intended to serve as Vdd (e.g. +5 volts). The thickness and width of each such conductor may vary in the manner described above. Capacitors 22A are bonded between strips 14A and 16A at periodic intervals. Preferably capacitors 22A are positioned such that they are located approximately mid-way between capacitors 22 (but on the opposite side of strip 12, as illustrated). In other words, they are staggered relative to the capacitors on the topside, preferably. Capacitors 22A are bonded to conductors 14A and 16A by means of metal areas 22B in the manner described above.

Preferably the entire cable is encapsulated in or surrounded by a suitable insulating material or cover coat 20, as illustrated. This may be polyimide, for example.

The high capacitance cable of the invention exhibits very low inductance but high capacitance. The capacitance in the cable works in a directly opposite manner to the inductance in a cable. In other words, the capacitance reduces voltage drops in the cable, whereas inductance increases voltage drops in a cable.

In the cable of the invention, both the ground conductor and the Vdd are available on either side of the cable for connection to the desired power supply or other electronic components. This greatly simplifies connection of the cable to the desired power supply or component.

Figure 3:
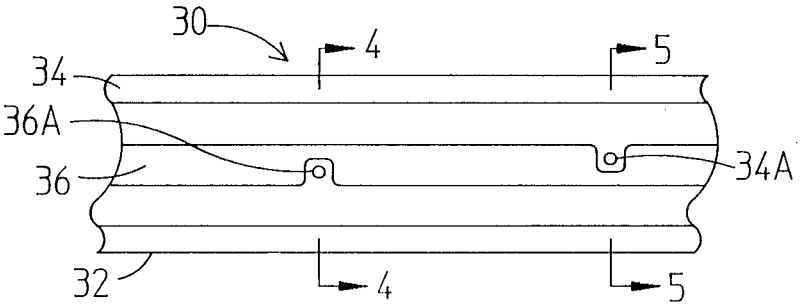
FIG. 3 is a top view of another embodiment of a high capacitance cable of the invention.
Figure 4:
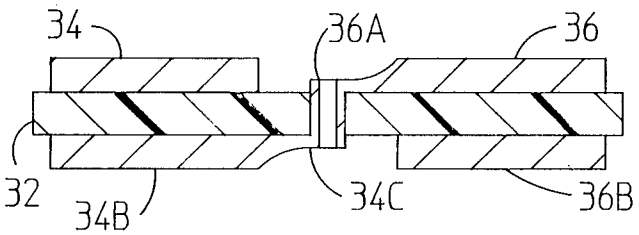
FIG. 4 is a cross-sectional view of the cable of FIG. 3 taken along line 4—4.
Figure 5:
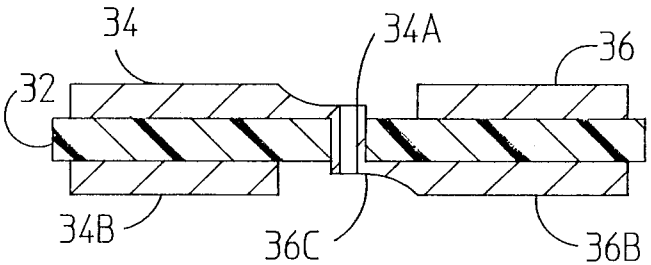
FIG. 5 is a cross-sectional view of the cable of FIG. 3 taken along line 5—5.

FIGS. 3–5 illustrate another embodiment of high capacitance cable 30 of the invention. In this embodiment conductors 34 and 36 are carried on the upper surface of insulating strip 32, and conductors 34B and 36B are carried on the lower surface of strip 32. At periodic intervals along its length the conductor 34 includes tabs 34A. Similarly, at periodic intervals along its length, conductor 36 includes tabs 36A. Of course, there may also be included capacitors connected between conductors 34 and 36, if desired, as shown in the previous figures.

As illustrated in the cross-sectional view of FIG. 4, conductor 34B includes a tab 34C which is vertically aligned with a tab 36A of conductor 36. The two tabs 36A and 34C are electrically connected by means of a plated-through hole (illustrated in the drawings) extending through strip 32 or by means of a staple or by other known means in a manner such that conductor 36 on the upper surface of strip 32 is electrically connected to conductor 34B on the lower surface of strip 32.

As illustrated in the cross-sectional view of FIG. 5, conductor 36B includes a tab 36C which is vertically aligned with a tab 34A of conductor 34. The two tabs 34A and 36C are electrically connected by means of a plated-through hole (as illustrated) or by any of the conventional means described above.

When the top Vdd conductor is electrically connected to the lower Vdd conductor in the manner described above, the electrical potentials in such Vdd conductors are equal (and of the same polarity). Similarly, when the ground conductors on the top and bottom surface are connected together, they will have the same electrical potential.

The high capacitance cable of the invention is very useful, for example, as a power cable for connecting electrical components or devices to a power supply. In most situations, at the ends of the cable, the top and bottom Vdd conductors can be connected together and then to the power supply or electrical component, as appropriate. Similarly, the top and bottom ground conductors at each end of the cable can be connected together and then to the power supply or electrical component, as appropriate.

Alternatively, if the Vdd conductors on the cable have the same electrical potential, such conductors can be connected to the same electrical component but not to each other. Also, if the ground conductors on the cable have the same electrical potential, such conductors can be connected to the same electrical component but not to each other.

The insulation surrounding the cable can be easily removed at each end of the cable to expose the conductors. For example, the insulation could be etched away or cut-away. Alternatively, the insulation may not extend completely to the end of the cable. The conductors may be appropriately connected to the desired component by means of solder connections, brazing, or conventional pressure connections, for example.

Other variants are possible without departing from the scope of the present invention.

What is claimed is:

1. A high capacitance cable comprising:

(a) a central continuous strip which is electrically insulating; said strip having upper and lower surfaces along its length;

(b) spaced-apart first and second conductors carried on said upper surface of said strip; said conductors extending along the length of said strip;

(c) spaced-apart third and fourth conductors carried on said lower surface of said strip; said conductors extending along the length of said strip;

(d) capacitors connected between said first and second conductors at periodic intervals; and (e) electrical insulation surrounding said strip and said conductors.

2. A high capacitance cable in accordance with claim 1, wherein said cable is flexible.

3. A high capacitance cable in accordance with claim 1, further comprising capacitors connected between said third and fourth conductors at periodic intervals.

4. A high capacitance cable in accordance with claim 3, wherein said capacitors comprise monolithic ceramic capacitors.

5. A high capacitance cable in accordance with claim 3, wherein said first and third conductors are approximately equal in width and are aligned vertically; and wherein said second and fourth conductors are approximately equal in width and are aligned vertically.

6. A high capacitance cable in accordance with claim 3, wherein said capacitors connected between said third and fourth conductors are longitudinally staggered with respect to said capacitors which are connected between said first and second conductors.

7. A high capacitance cable in accordance with claim 1, wherein said first and fourth conductors are electrically connected to each other through said central continuous strip.

8. A high capacitance cable in accordance with claim 7, wherein said second and third conductors are electrically connected to each other through said central continuous strip.

9. A high capacitance cable comprising:

(a) a central continuous strip which is electrically insulating; said strip having upper and lower surfaces along its length;

(b) spaced-apart first and second conductors carried on said upper surface of said strip; said conductors being parallel and extending along the length of said strip;

(c) spaced-apart third and fourth conductors carried on said lower surface of said strip; said conductors being parallel and extending along the length of said strip;

(d) electrical insulation surrounding said strip and said conductors; and (e) capacitors connected between said first and second conductors at periodic intervals.

10. A high capacitance cable in accordance with claim 9, wherein said cable is flexible.

11. A high capacitance cable in accordance with claim 9, further comprising capacitors connected between said third and fourth conductors at periodic intervals.

12. A high capacitance cable in accordance with claim 11, wherein said capacitors comprise monolithic ceramic capacitors.

13. A high capacitance cable in accordance with claim 11, wherein said first and third conductors are approximately equal in width and are aligned vertically; and wherein said second and fourth conductors are approximately equal in width and are aligned vertically.

14. A high capacitance cable in accordance with claim 11, wherein said capacitors connected between said third and fourth conductors are longitudinally staggered with respect to said capacitors which are connected between said first and second conductors.

15. A high capacitance cable in accordance with claim 9, wherein said first and fourth conductors are electrically connected to each other through said central continuous strip.

16. A high capacitance cable in accordance with claim 15, wherein said second and third conductors are electrically connected to each other through said central continuous strip.

* * * * *